US007429119B2

(12) United States Patent
Gedack et al.

(10) Patent No.: US 7,429,119 B2
(45) Date of Patent: Sep. 30, 2008

(54) PROTECTIVE DEVICE FOR A LAMP

(75) Inventors: Horst Gedack, Munich (DE); Thomas Mehr, Dollnstein (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 11/791,370

(22) PCT Filed: Nov. 18, 2005

(86) PCT No.: PCT/DE2005/002073

§ 371 (c)(1),
(2), (4) Date: May 23, 2007

(87) PCT Pub. No.: WO2006/056169

PCT Pub. Date: Jun. 1, 2006

(65) Prior Publication Data

US 2008/0042545 A1 Feb. 21, 2008

(30) Foreign Application Priority Data

Nov. 24, 2004 (DE) ..... 10 2004 056 730

(51) Int. Cl.
*F21V 15/04* (2006.01)

(52) U.S. Cl. ..... 362/263; 362/377; 362/378

(58) Field of Classification Search ..... 362/263, 362/376, 377, 378

See application file for complete search history.

(56) References Cited

U.S. PATENT DOCUMENTS

| | | | | |
|---|---|---|---|---|
| 4,066,888 | A | 1/1978 | Gassmann et al. | |
| 4,878,159 | A * | 10/1989 | Blaisdell et al. | 362/222 |
| 5,386,355 | A * | 1/1995 | Acks | 362/267 |
| 5,388,034 | A * | 2/1995 | Allen et al. | 362/459 |
| 5,542,535 | A | 8/1996 | Dalton et al. | |
| 6,652,127 | B2 * | 11/2003 | Tarabula | 362/376 |
| 2004/0095770 | A1 | 5/2004 | Meyer et al. | |
| 2004/0188298 | A1 | 9/2004 | Shatford et al. | |

* cited by examiner

*Primary Examiner*—Laura Tso
(74) *Attorney, Agent, or Firm*—William E. Meyer

(57) ABSTRACT

A protective device for a lamp, especially a high-pressure xenon discharge lamp or high-pressure mercury vapor discharge lamp, includes a pressurized lamp vessel and a protective envelope which surrounds the lamps in at least some sections, can be fixed to the lamp by two closures that engage around lamp shafts, and is made of a gas-permeable fleece.

20 Claims, 4 Drawing Sheets

PROTECTIVE DEVICE FOR A LAMP

TECHNICAL FIELD

The invention relates to a protective device for a lamp as claimed in the precharacterizing clause of claim 1.

PRIOR ART

Lamps having a pressurized lamp vessel, for example high-pressure XBO® xenon or HBO® mercury discharge lamps, are used for a large number of applications, in particular in medicine and projection engineering. Owing to the risk of explosion of such lamps which are under a high internal pressure (approximately 5 to 15 bar) even in the cold state, for safety reasons suitable protective devices need to be provided during transportation and during fitting or removal of the lamps in order to prevent any risk of injury to people owing to splinters and particles occurring in the event of the lamp vessel bursting.

A protective device for such lamps in which the lamp is enveloped in a protective envelope comprising a plate-shaped, rectangular piece of PVC plastic and is fixed to two bases of the lamp by being tied together with cords is known from the general prior art. The lamp surrounded by the protective envelope can also be packaged in a cardboard box filled with shock-absorbent material, for example foam, for transportation and storage. The excess pressure developing in the gas-impermeable PVC protective envelope in the event of the lamp vessel exploding can escape through gaps formed between the base and the protective envelope if the cords are suitably tightened, the PVC protective envelope preventing splinters and other particles from emerging.

One disadvantage with the previously described solution is the fact that, owing to the gas-impermeable PVC protective envelope and the closures which have an undefined degree of tightness, the hazardous states explained in more detail below may occur. If, firstly, the cords are not tightened sufficiently, the protective envelope does not bear sufficiently tightly against the bases and it is possible for sharp-edged splinters and particles to be flung outwards in projectile fashion through the annular gaps between the base and the protective envelope in the event of the lamp vessel exploding. Secondly, the excess pressure produced cannot escape from the protective envelope when the cords are tightened too much and blows the protective envelope up in the manner of a balloon. As a result, when the lamp is subsequently handled, for example when the protective envelope is opened, glass splinters may be flung outwards and may result in people being injured. A further disadvantage of this known solution consists in the fact that the relatively stiff PVC protective envelope prevents a uniform distribution over a large area of the forces acting on the packaging during transportation over the lamp surface and, as a result, breakage of the lamp in the packaging may arise.

DESCRIPTION OF THE INVENTION

The invention is based on the object of providing a protective device for a lamp in which improved protection against splinters at the same time as optimized protection of the lamp against breakage is made possible in comparison with conventional solutions.

This object is achieved as regards the protective device for a lamp by the features of claim 1. Particularly advantageous embodiments of the invention are described in the dependent claims.

The protective device according to the invention for a lamp, in particular for a high-pressure xenon or mercury discharge lamp, having a pressurized lamp vessel uses a protective envelope, which surrounds at least sections of the lamp and can be fixed to the lamp by means of two closures engaging around bases of the lamp. According to the invention, the protective envelope consists of a gas-permeable nonwoven material, which prevents a pressure buildup within the protective envelope in the event of the lamp bursting and, as a result, makes improved protection against splinters possible. Furthermore, owing to the protective envelope in the form of a nonwoven material, the lamp is held elastically, and this distributes impacts occurring during transportation and storage over a large area and uniformly over the lamp surface and therefore considerably reduces the risk of breakage of the lamp.

In accordance with one particularly preferred exemplary embodiment, the nonwoven material consists of a thermoplastic material, preferably polypropylene (PP), the effect of the protection against splinters additionally being improved, with the lamp being held in optimum fashion in the protective envelope, by the high resilience and the viscoelasticity of the PP nonwoven material. Furthermore, the lamp parts can be handled without any risk to the user even after the lamp has burst owing to the very resistant PP nonwoven material.

It has proven to be particularly advantageous if the nonwoven material has a weight per unit area of between approximately 250 g/m$^2$ and 350 g/m$^2$, preferably of 300 g/m$^2$.

The nonwoven material may be smoothed on the outside in order to ensure, for example, improved printability or to optimize the mechanical material properties. For this purpose, thermal smoothing processes known from the general prior art or the like can be used.

Preferably, at least sections of the lamp are enveloped in the protective envelope, this protective envelope surrounding the lamp at least with one layer, in particular with two layers. For this purpose, the length of the protective envelope advantageously corresponds to the circumference, in particular twice the circumference, of the lamp vessel. Owing to the lamp being enveloped in the protective envelope, installation and removal of the lamp in and from the lamp housing with the protective envelope fitted is made possible since, even in the installed state, the protective envelope can be unwound from the lamp or fitted to it, i.e. at least sections of the lamp are surrounded by the protective envelope during installation or removal of the lamp and people are protected in the event of the lamp exploding.

The protective envelope, when unwound, preferably has a width which is smaller than the lamp length and/or larger than the length of the lamp vessel, an unwound width of the protective envelope which is selected to be larger than the length of the lamp vessel making it possible to fit the protective device to the bases of the lamp and, owing to the lamp vessel being completely covered, improves the protection against splinters. A smaller width of the protective envelope in comparison with the lamp length simplifies installation and removal of the lamp in the lamp housing with the protective envelope fitted, since the lamp sections required for the fitting process do not need to be covered by the protective envelope. As a result, the lamp may be surrounded by the protective envelope during installation or removal of the lamp and protect people from splinters and particles in the event of the lamp exploding.

A strip with at least one eyelet which engages around the protective envelope flat on the outside and fixes it to the lamp is advantageously used as the closure. Owing to the closures, which are impermeable to splinters and particles and have a gap-free design in comparison with the prior art, with defined sealing of the protective device, an optimized effect of protection against splinters results.

At least sections of the strips are preferably in the form of an adhesive strip and/or a fleecy strip. This simplifies the process for fitting or removing the protective envelope to or from the bases of the lamp, and the closure can be used a plurality of times, for example for safe return transportation of the lamp to the manufacturer.

In a further preferred exemplary embodiment, the closure is at least one adhesive strip applied to the protective envelope. It can be adhesively bonded, sewn or fixed in another way to the nonwoven material and can be brought into engagement directly with the nonwoven material or a mating piece applied thereto, for example a fleecy strip.

In order to automate the production of the protective device, the closure is advantageously designed to have at least one fixing means, which engages around the protective envelope on the outside and fixes it to the lamp. In this regard, for example, a cable tie provided with latching elements or the like can be used as the fixing means.

The lamp surrounded by the protective envelope is preferably stored and transported in a container, for example a cardboard box, with shock-absorbent material, in particular foam.

BRIEF DESCRIPTION OF THE DRAWINGS

The invention will be explained in more detail below with reference to a preferred exemplary embodiment. In the drawings.

PREFERRED EMBODIMENT OF THE INVENTION

Figure 1:
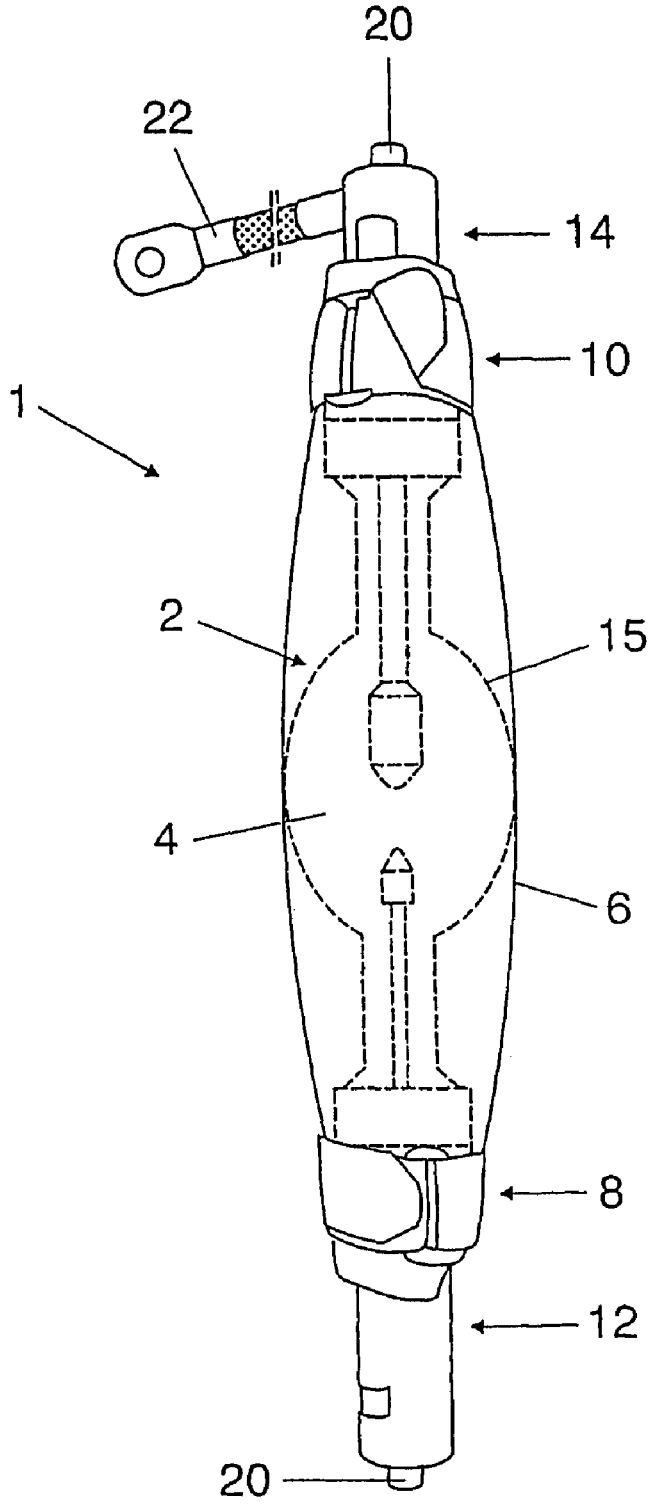
FIG. 1 shows a three-dimensional view of a lamp having a protective device according to the invention.

As shown in FIG. 1, the protective device 1 according to the invention for a lamp 2 having a pressurized lamp vessel 4, illustrated by dashed lines, uses a protective envelope 6 consisting of gas-permeable polypropylene nonwoven material (PP nonwoven material), which surrounds sections of the lamp 2 and is fixed to bases 12, 14 of the lamp 2 by means of two touch-and-close fastening strips 8, 10. The gas-permeable design of the protective envelope 6 prevents a pressure buildup within the protective envelope 6 in the event of the lamp 2 exploding and therefore makes improved protection against splinters possible. The lamp 2 is enveloped in the protective envelope 6 and is surrounded by it with two layers, the double-layer application of the protective envelope 6 further increasing the effect of protection against splinters. Owing to the fact that the protective envelope 6 is formed from PP nonwoven material, the lamp 2 is held elastically, and this distributes impacts occurring during transportation over a large area and uniformly over the lamp surface 15 and, as a result, considerably reduces the risk of breakage of the lamp 2.

The touch-and-close fastening strips 8, 10 used as closures engage around the protective envelope 6 flat on the outside and fix it to the lamp 2. Owing to the elastic and gas-permeable design of the protective envelope 6, the touch-and-close fastening strips 8, 10 can terminate tightly at the bases 12, 14 and can be optimized against the occurrence of splinters and particles. Since the protective envelope 6 can be unwound or fitted to the lamp 2 even when said lamp 2 is in the installed state, installation and removal of the lamp 2 in and from the lamp housing (not illustrated) is possible with the protective envelope 6 fitted. That is to say the lamp 2 is surrounded by the protective envelope 6 during installation or removal of the lamp, and people are protected from splinters and particles in the event of the lamp exploding. The touch-and-close fastening strips 8, 10 simplify the handling of the protective device 1 considerably, since they can be opened and closed easily and without any additional tool.

Figure 2:
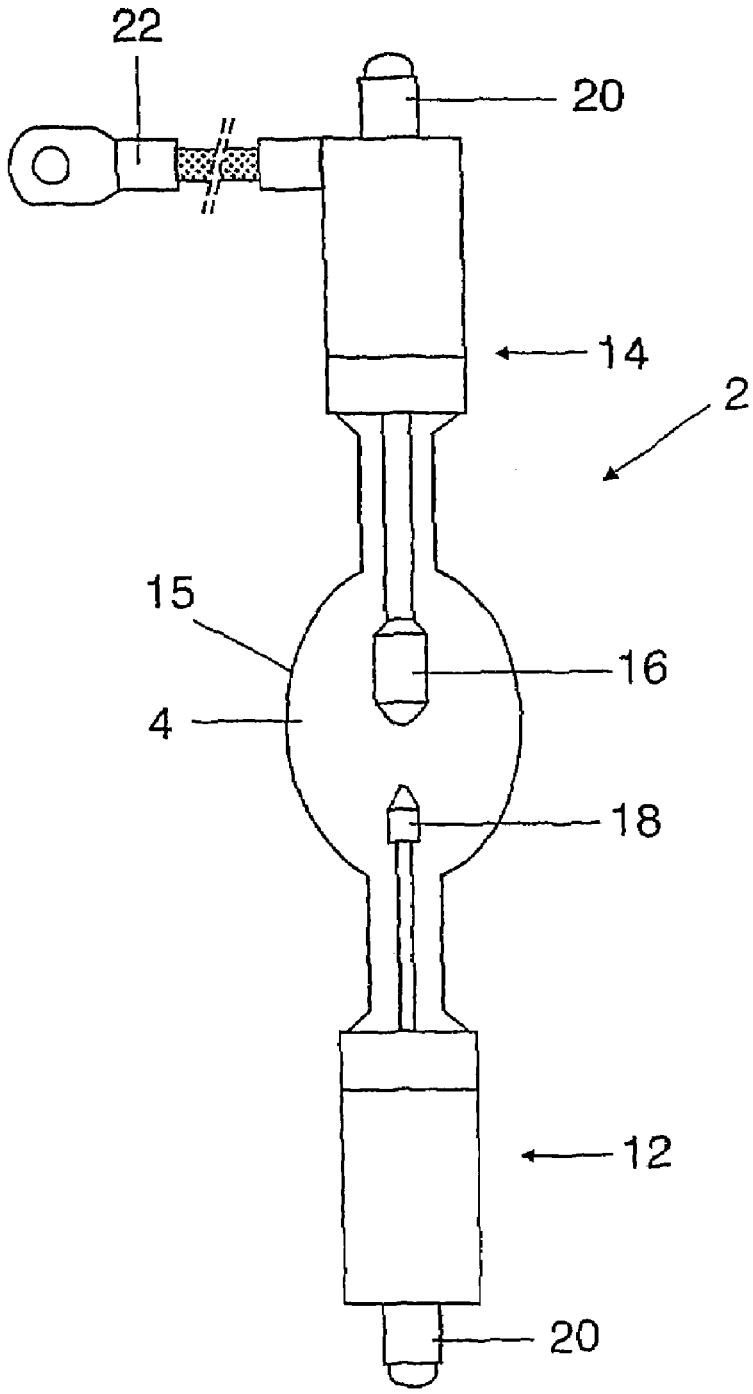
FIG. 2 shows a detailed illustration of the lamp shown in FIG. 1.

In the exemplary embodiment illustrated, as shown in FIG. 2 a lamp 2 in the form of an XBO® xenon short-arc lamp having a conventional design is used. Such a short-arc high-pressure discharge lamp 2 essentially comprises an anode 16, a cathode 18 and the lamp vessel 4, which is filled with high-purity xenon gas and merges on both sides with an approximately cylindrical lamp neck having bases 12, 14, which lamp neck is provided on the cathode side and the anode side with a contact pin 20 and, on the anode side, has an additional contact connection 22.

Figure 3:
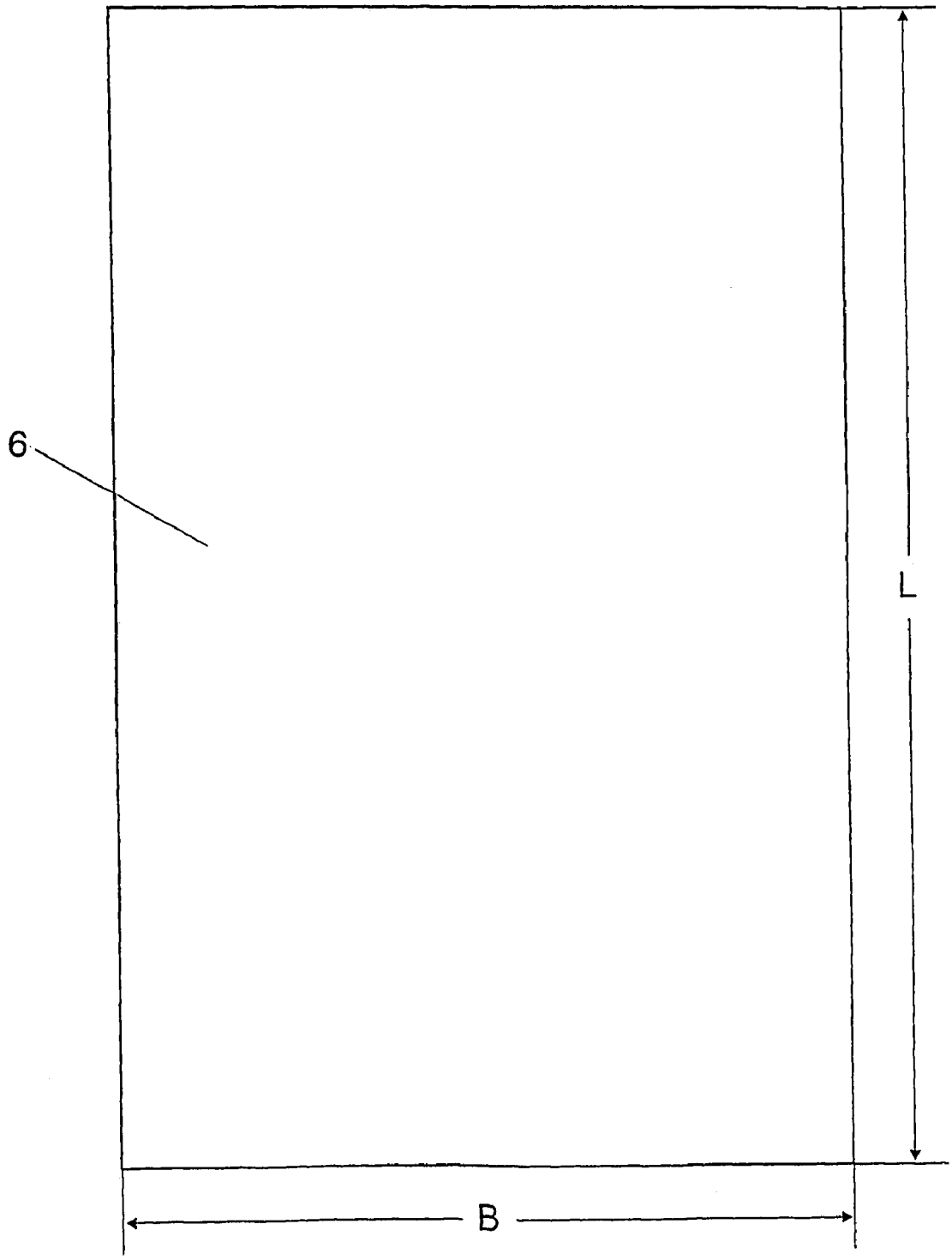
FIG. 3 shows a plan view of the protective envelope shown in FIG. 1.

As shown in FIG. 3, which shows a plan view of the protective envelope 6 of the protective device 1 shown in FIG. 1, said protective envelope 6 has an approximately rectangular basic shape with a width B of approximately 29 cm and a length L of approximately 50 cm. The protective envelope 6 consists of a PP stitchbond nonwoven material having a weight per unit area of approximately 300 g/m$^2$. Such a grammage has proven to be particularly advantageous since PP nonwoven material having a substantially lower weight per unit area tends to have locally thinner points, and, as a result, represents a safety risk. PP nonwoven material having a substantially higher weight per unit area would make the specialist embedding of the lamp 2 in the packaging (not illustrated) unnecessarily difficult owing to its stiffness.

Figure 4:
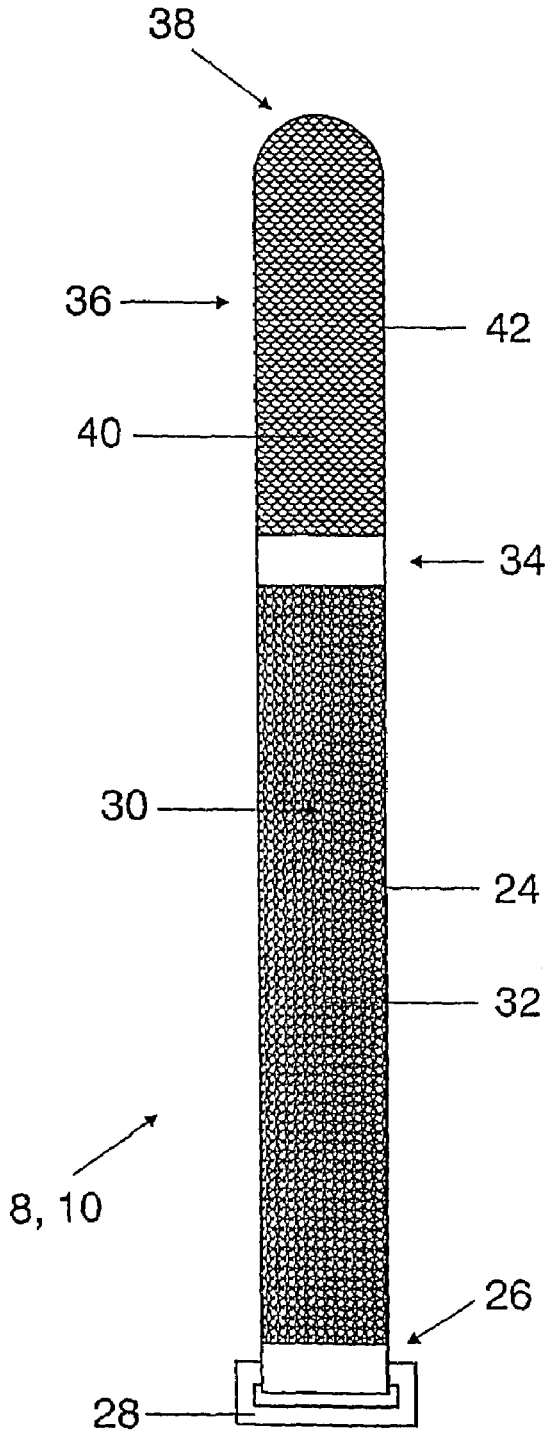
FIG. 4 shows a detailed illustration of a touch-and-close fastening strip from FIG. 1.

FIG. 4 shows a detailed illustration of one of the two touch-and-close fastening strips 8, 10 used in FIG. 1 as closures for the protective envelope 6. This touch-and-close fastening strip comprises a strip 24, which, at a first end section 26, engages around an essentially rectangular plastic eyelet 28, which is fixed by the end section 26 being sewn to the strip 24. Sections of an upper side 30 of the touch-and-close fastening strip 8, 10 are formed as a fleecy strip 32. At a second end section 34, the strip 24 is provided with a tab 36, which tapers towards a tip 38 in order to facilitate insertion into the plastic eyelet 28 and forms an adhesive strip 42 by means of nylon hooks 40 which are applied.

In order to close the protective device 1, the touch-and-close fastening strips 8, 10 are laid around the lamp 2, which has already been enveloped in the protective envelope 6, the tab 36 in the form of an adhesive strip 42 is passed through the plastic eyelet 28 and, once it has been drawn tight, is fixed to the fleecy strip 32 by being pressed against it. Alternatively, it is possible to adhesively bond the adhesive strip 42 directly to the PP nowoven material 6, it being possible to use the PP nonwoven material 6 or an adhesively bonded fleecy strip 32 as the mating piece for the adhesive strip 42. Since the closure is in the form of a touch-and-close fastening strip 8, 10, it can be opened by hand once the lamp 2 has been installed and the protective envelope 6 unwound.

The protective device 1 can be used a plurality of times and is therefore suitable, for example, for safe return transportation of the lamp 2 to the manufacturer.

For transportation and storage, the lamp 2 surrounded by the protective envelope 6 is additionally packaged in a cardboard box (not illustrated) filled with shock-absorbent material, for example foam.

The protective device 1 according to the invention is not restricted to the described embodiment with a protective envelope 6 consisting of PP nonwoven material, but instead any gas-permeable material known from the prior art which makes the desired effect of protection against splinters possible can be used as the protective envelope 6. According to the invention, the protective device 1 can be used for all lamps known from the prior art having a pressurized lamp vessel.

The invention discloses a protective device 1 for a lamp 2, in particular for a high-pressure xenon or mercury discharge lamp, having a pressurized lamp vessel 4, having a protective envelope 6, which surrounds at least sections of the lamp 2 and can be fixed to the lamp 2 by means of two closures 8, 10 engaging around lamp shafts 12, 14 of the lamp 2, the protective envelope 6 consisting of a gas-permeable nonwoven material.

The invention claimed is:

1. A protective device (1) for a high-pressure discharge lamp, having a pressurized lamp vessel (4), having a protective envelope (6), which surrounds at least sections of the lamp (2) and can be fixed to the lamp (2) by means of two closures (8, 10) engaging around bases (12, 14) of the lamp (2), characterized in that the protective envelope (6) consists of a gas-permeable nonwoven material.

2. The protective device as claimed in claim 1, the nonwoven material consisting of a thermoplastic material, preferably polypropylene (PP).

3. The protective device as claimed in claim 1, the nonwoven material having a weight per unit area of between approximately 250 g/m$^2$ and 350 g/m$^2$, preferably of 300 g/m$^2$.

4. The protective device as claimed in claim 1, the nonwoven material being smoothed on the outside.

5. The protective device as claimed in claim 1, at least sections of the lamp (2) being enveloped in the protective envelope (6).

6. The protective device as claimed in claim 5, the protective envelope (6) surrounding the lamp (2) at least with one layer.

7. The protective device as claimed in claim 1, the protective envelope (6), when unwound, having a width (B) which is not greater than or equal to the lamp length and not less than or equal to the length of the lamp vessel (4).

8. The protective device as claimed in claim 1, the protective envelope (6) having a length (L) which at least corresponds to the circumference, preferably twice the circumference, of the lamp vessel (4).

9. The protective device as claimed in claim 1, the closure (8, 10) being a strip (24) with at least one eyelet (28), which strip engages around the protective envelope (6) flat on the outside and fixes it to the lamp (2).

10. The protective device as claimed in claim 9, at least sections of the strip (24) forming an adhesive strip (42).

11. The protective device as claimed in claim 1, the closure (8, 10) being at least one adhesive strip (42) applied to the protective envelope (6).

12. The protective device as claimed in claim 1, the lamp (2) which is surrounded by the protective envelope (6) being stored in shock-absorbent material, in particular foam.

13. The protective device as claimed in claim 2, the nonwoven material having a weight per unit area of between approximately 250 g/m$^2$ and 350 g/m$^2$, preferably of 300 g/m$^2$.

14. The protective device as claimed in claim 2, the nonwoven material being smoothed on the outside.

15. The protective device as claimed in claim 3, the nonwoven material being smoothed on the outside.

16. The protective device as claimed in claim 2, at least sections of the lamp (2) being enveloped in the protective envelope (6).

17. The protective device as claimed in claim 3, at least sections of the lamp (2) being enveloped in the protective envelope (6).

18. The protective device as claimed in claim 4, at least sections of the lamp (2) being enveloped in the protective envelope (6).

19. The protective device as claimed in claim 2, the protective envelope (6), when unwound, having a width (B) which is not greater than or equal to the lamp length and not less than or equal than the length of the lamp vessel (4).

20. The protective device as claimed in claim 9, at least sections of the strip (24) forming a fleecy strip (32).

* * * * *